United States Patent [19]

Miyoshi

[11] 4,081,931

[45] Apr. 4, 1978

[54] ANTI-SMOKE HANGING WALL AND CONSTRUCTION METHOD

[76] Inventor: Kiyotaka Miyoshi, 2-38, 2-Chome, Kamiya-cho,, Hiroshima-shi, Hiroshima-ken, Japan

[21] Appl. No.: 678,657

[22] Filed: Apr. 20, 1976

[30] Foreign Application Priority Data

Apr. 23, 1975 Japan ..... 50-5865[U]

[51] Int. Cl.[2] ..... E04B 5/52

[52] U.S. Cl. ..... 52/39; 52/484

[58] Field of Search ..... 52/39, 122, 144, 145, 52/484, 710, 240; 49/409, 412; 248/317; 40/128

[56] References Cited

U.S. PATENT DOCUMENTS

| | | | |
|---|---|---|---|
| 2,655,348 | 10/1953 | Siering | 98/40 D |
| 2,876,504 | 3/1959 | Bennett | 49/409 |
| 2,884,512 | 4/1959 | Wakefield | 98/40 D |
| 2,939,543 | 6/1960 | Zingone | 52/484 |
| 3,067,323 | 12/1962 | Kember | 52/144 |
| 3,098,519 | 7/1963 | Myers | 49/409 |
| 3,557,499 | 7/1969 | Dickie | 52/64 |
| 3,596,425 | 3/1971 | Kodnras | 52/476 |

FOREIGN PATENT DOCUMENTS

| | | | |
|---|---|---|---|
| 2,421,320 | 11/1974 | Germany | 49/409 |
| 2,459,443 | 11/1975 | Germany | 52/240 |

*Primary Examiner*—Ernest R. Purser
*Assistant Examiner*—Henry Raduazo
*Attorney, Agent, or Firm*—James C. Wray

[57] ABSTRACT

An anti-smoke hanging wall has a channel bar with a downward-opening slot which is exposed in the ceiling of a building. Bolts hanging from said channel bar slot support a wall-bearer and a wall, hanging from said channel bar slot by means of said wall-bearer.

17 Claims, 3 Drawing Figures

ANTI-SMOKE HANGING WALL AND CONSTRUCTION METHOD

BACKGROUND OF THE INVENTION

In the event of a fire in a building, the fire must be prevented from spreading, and occupants of the building or the people working there must be swiftly evacuated. For this purpose various fire extinguishers and fire alarms are available. The smoke generated by a fire quickly spreads along the ceiling and reaches far from the origin of the fire. On account of this phenomenon even the people who do not need to hasten their evacuation become disquieted so that they stampede, resulting in a disaster. To prevent such a calamity, anti-smoke hanging walls have been devised to be hung from the ceilings at intervals. Tests show that hanging walls effectively prevent the smoke from spreading along the ceiling.

Anti-smoke hanging walls are mostly made of glass plates at the top of which holes are bored. Using the holes, the glass plates are hung from the ceiling. In other devices press beads are oppositely provided within metal frames fitted near the ceiling, and glass plates are frictionally held between the press beads. The former method of connecting the plates is relatively difficult to execute and is liable to break the glass; moreover, it spoils the appearance. In the latter method, the glass plates are pressed in; therefore this method excels in ease and rapidity of execution but gives a feeling of disquiet to people passing under the mounted glass plates.

SUMMARY OF THE INVENTION

An object of the invention is to provide an anti-smoke hanging wall comprising a channel bar with a downward-opening exposed slot, which bar is attached to the ceiling of a building, a plurality of hanging bolts hanging in the channel bar slot, a wall-bearer fitted to the lower tip of the bolts and a wall hanging from the channel bar slot by means of the wall-bearer.

Another object of the present invention is to provide a method of constructing anti-smoke hanging walls in the following steps:

- attaching a metal fixture to a member fixed to the ceiling of a building,
- bolting a channel bar with a downward open slot to the metal fixture,
- attaching to the channel bar a plurality of hanging bolts which extend downward,
- connecting a wall-bearer to the lower tip of said hanging bolts,
- inserting the top edge of the hanging wall into said channel bar slot and fitting the bottom edge of said wall to said wall-bearer, and
- padding a gap between said slot and said wall.

According to the present invention, the channel bar is arranged parallel to the ceiling member, and the wall is easily and rapidly fitted to the bar. The fitting needs no welding, and the position is freely variable along the channel bar with great convenience in many respects. Further, replacement of ceiling member can be done without removing the channel bar.

Other objects of the present invention will become apparent from the following description of its embodiment.

Figure 1:
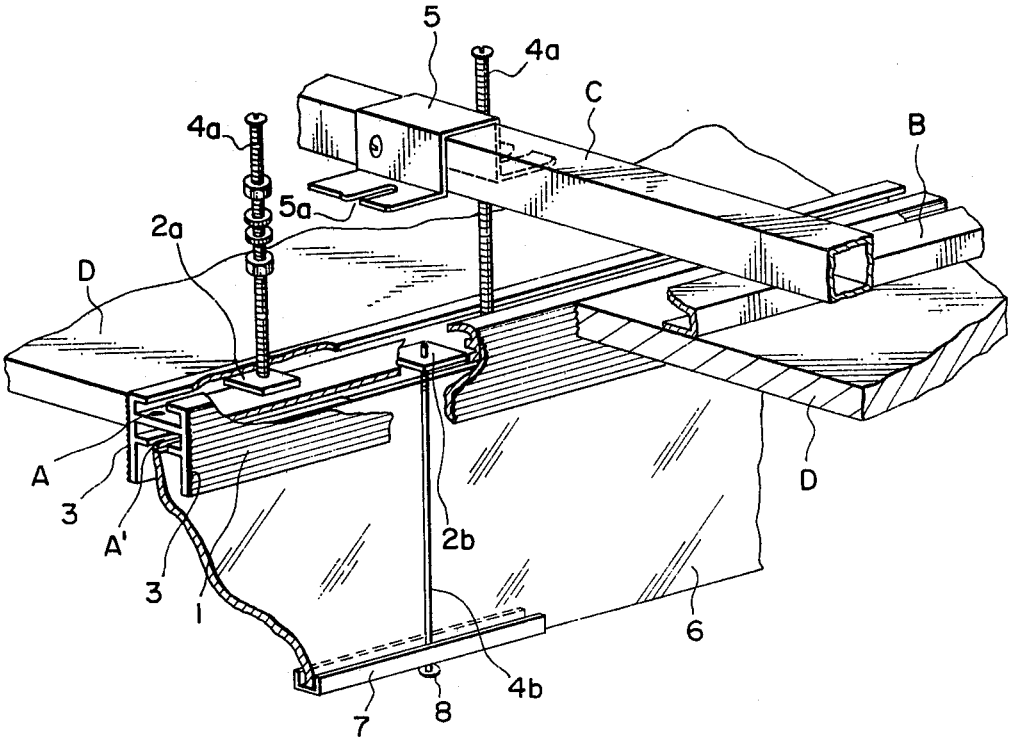
FIG. 1 is a partial cutaway perspective view of one embodiment of the present invention.

DETAILED DESCRIPTION OF THE INVENTION:

Referring to the drawings, one embodiment of the present invention is described.

Channel bar 1 featuring the present invention has an upward-opening slot A with shoulders A-1, A-2 and slot A′ with shoulders A′-1, A′-2. Skirts A″ on both sides of downward-opening slot A′ constitute a downward opening channel. The side surfaces of channel bar 1 and the external sides of skirts A″ constitute planes on which are formed a plurality of ribs 3 in the longitudinal direction of the channel bar.

In slots A, A′ of the channel bar 1 are inserted a plurality of members 2*a*, 2*b*, preliminarily bored and tapped with screw holes.

A ceiling beam C to carry the ceiling member D, and stiffeners B are fitted on the back of the ceiling of a building.

At first, a metal fixture 5 is attached to ceiling beam C or stiffener B. In the illustrated embodiment, a plurality of metal fixtures 5 are screwed firmly to the ceiling beam C. The metal fixture 5 has a transverse projection, which carries a slit 5*a*.

First and second hanging bolts 4*b* and 4*a* are employed. The first hanging bolt suspends the wall-bearer from the channel. The second hanging bolt supports the channel from the ceiling beams.

The tip of a relatively long second hanging bolt 4*a* is first screwed into a screw hole in member 2*a*, and the projection of metal fixture 5 is squeezed between two nuts provided midway on hanging bolt 4*a*, whereby the hanging bolt 4*a* is fixed midway in the slit 5*a*. In this manner channel bar 1 is hung from the required place above a room.

The ceiling member D is held in position with its side surface bearing against the side surface of the channel bar 1 by the conventional method, for instance, by some means fitted to the ceiling beam C or the stiffeners B.

When the ceiling member is installed, the downward-opening slot A′ of the channel bar 1 is exposed in the room. Then the tip of first hanging bolt 4*b*, slightly longer than the height of the wall to be hung, is firmly screwed into a screw hole in member 2*b*, which is inserted into slot A′ of channel bar 1. Member 2*b* and bolt 4*b* are slid in the slot A′ to such a position that said bolt 4*b* comes between the edges of adjacent hanging walls. After the bolt 4*b* is positioned, the top edge of a laterally extending wall, for instance, glass plate 6, is inserted between skirts A″ of the channel bar 1, while the bottom edge of wall 6 is engaged with the wall bearer 7, comprising an upward opening channel member which is fixed to the lower tip of bolt 4*b* by means of a cap nut. Thereupon, the gap left between glass plate 6 and skirts A″ of the channel bar 1 is padded with a caulking material to fix the glass plate.

Figure 2:
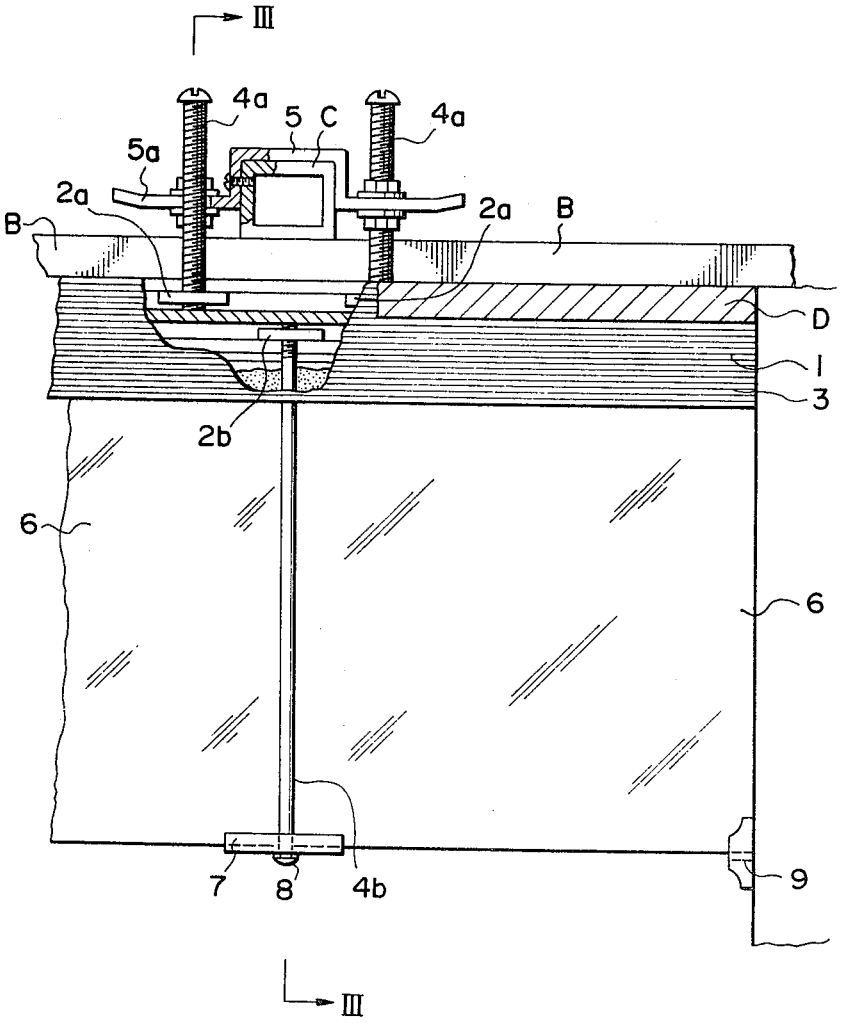
FIG. 2 is a partial cutaway front elevation corresponding to FIG. 1.
Figure 3:
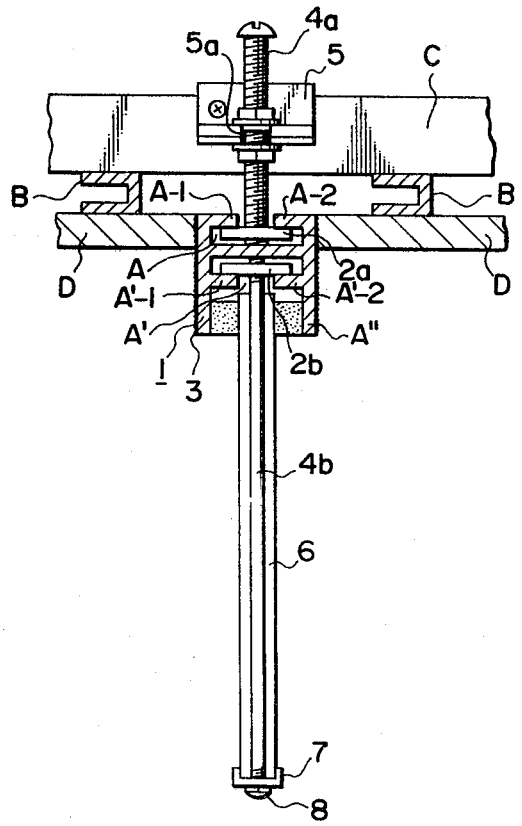
FIG. 3 is a sectional view along III — III of FIG. 2.

The part of the hanging wall which abuts the building wall or pillar is, as shown in FIG. 2, supported by a prop 9, fixed to the building wall or pillar.

The material for the anti-smoke hanging wall according to the present invention is not limited to the common glass plate. It can be a wired glass plate or a reinforced glass. When visibility is not considered, of course, a metal plate or a slate board may be used. Also, the caulking material may be replaced with a packing material.

As a result of the above mentioned arrangement, the hanging wall is provided along the ceiling member and separates an upper area of the room.

While the invention has been described with reference to specific embodiments, it will be obvious to those skilled in the art that various modifications of the invention can be constructed without departing from the scope of the invention. The scope of the invention is defined in the following claims.

I claim:

1. Anti-smoke hanging wall comprising:

a channel bar with a downward-opening slot, said bar being exposedly attached to the ceiling member of a building:

a plurality of hanging bolts having upper ends connected to said channel bar, said bolts hanging from said channel bar and having lowertips remote from said channel bar;

a wall bearer fixed to said lower tips of said hanging bolts; and a hanging wall positioned between said channel bar slot and said wall bearer, the wall bearer supporting the wall.

2. The anti-smoke hanging wall of claim 1, wherein said hanging bolt is hung through the downward opening slot in said channel bar and wherein an upper lip of the bolt is fixed to another member slidably inserted in the channel bar slot.

3. Anti-smoke hanging wall of claim 1, wherein said channel bar is attached through second hanging bolts and metal fixtures to members fitted on a ceiling of a building.

4. Anti-smoke hanging wall of claim 3, wherein said channel bar has an upward-opening slot and a member slidably inserted in said slot is connected to said second hanging bolt.

5. The anti-smoke hanging wall of claim 1 wherein said hanging bolts are slidably engaged in the channel bar and are positioned adjacent a side edge of the hanging wall.

6. Construction method for an anti-smoke hanging wall comprising the following steps:

attaching a metal fixture to a member fitted to the building ceiling, bolting a channel bar with a downward opening slot to said metal fixture, connecting a downward extending hanging bolt to said channel bar, attaching a wall-bearer to a lower tip of the hanging bolt, and inserting a top edge of the hanging wall in said channel bar slot and engaging a bottom edge of said wall with said wall-bearer

7. The construction method of claim 6, characterized in that the hanging wall is engaged with the wall-bearer at the lower tip of the hanging bolt by moving the hanging bolt up to a side edge of the hanging wall.

8. The construction method of claim 6 characterized by the bolting step comprising connecting a second bolt to the fixture and to a tapped member slidable within an upward opening slot in the channel bar.

9. The construction method of claim 6 wherein the connecting step comprises connecting the first mentioned hanging bolt to a tapped member slidable within the downward opening slot.

10. The construction method of claim 6 further comprising padding a gap between said channel bar slot and said wall.

11. An anti-smoke hanging wall supporting construction comprising a downward-opening channel member having horizontally elongated downward extending sidewalls, means for connecting the channel member to a ceiling structure and means for suspending a support for an anti-smoke wall from the channel member, the means for suspending having upper ends connected to the channel member and having lower ends remote from the channel member, the support being connected to the lower ends of the suspending means, a hanging wall positioned between the channel member and the support, the support holding the wall with an upper portion of the wall between sidewalls of the channel member.

12. The anti-smoke hanging wall supporting construction of claim 10 wherein the channel member comprises a horizontal portion extending between the sidewalls and wherein the means for suspending comprises inward extending shoulders which extend oppositely inward from the sidewalls, and which terminate spaced from each other, leaving a gap, thereby forming a downward-opening slot, whereby wall supporting members may be mounted in the slot.

13. The anti-smoke hanging wall supporting construction of claim 11 further comprising second inward extending shoulders at tops of the sidewalls, extending inwardly and terminating spaced from each other in a gap, thereby forming an upward-opening slot, which comprises the means for connecting the channel member to a ceiling structure, whereby suspension means may be connected in the upward-opening slot.

14. The anti-smoke hanging wall supporting construction of claim 11 wherein the means for suspending a support further comprises a member slidable within the downward opening slot, having a tapped hole, and an elongated bolt connected to the slidable member for moving along the downward opening slot, and further comprising a support connected to the elongated bolt.

15. The anti-smoke hanging wall supporting construction of claim 13 wherein the support comprises an upward opening channel member having a horizontal portion medially supported on a head of the bolt.

16. The anti-smoke hanging wall supporting construction of claim 14 further comprising first and second anti-smoke wall plates having adjacent end portions of lower edges mounted in the upward opening channel, having adjacent lateral edges positioned adjacent the bolt and having upper portions positioned between the sidewalls of the channel member.

17. The anti-smoke hanging wall supporting construction of claim 10 wherein the means for suspending a suport comprises a hanging bolt slidably received in the channel member and extending vertically downward therefrom, and a wall-bearer attached to a lower end of the hanging bolt, and wherein the hanging bolt is positioned at a side edge of an anti-smoke hanging wall.

* * * * *